US007927159B2

(12) United States Patent
Zhang et al.

(10) Patent No.: US 7,927,159 B2
(45) Date of Patent: Apr. 19, 2011

(54) CONTACT CARRIER HAVING CONTACT TERMINALS ARRANGED ALTERNATIVELY ALONG SIDES

(75) Inventors: Jie-Feng Zhang, Shenzhen (CN); Kun Tang, Shenzhen (CN); Fu-Jin Peng, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/884,187

(22) Filed: Sep. 17, 2010

(65) Prior Publication Data

US 2011/0065338 A1 Mar. 17, 2011

(30) Foreign Application Priority Data

Sep. 17, 2009 (CN) ..... 200920310587

(51) Int. Cl.
*H01R 9/24* (2006.01)

(52) U.S. Cl. ..... 439/885; 29/884

(58) Field of Classification Search ..... 439/885, 439/862; 29/884
See application file for complete search history.

(56) References Cited

U.S. PATENT DOCUMENTS 4,616,416 A * 10/1986 Cabaud ..... 29/884
6,638,121 B1 * 10/2003 Walker et al. ..... 439/885
6,922,889 B2 8/2005 Tsai
6,976,888 B2 12/2005 Shirai et al.
7,621,788 B1 * 11/2009 Feng ..... 439/885

* cited by examiner

*Primary Examiner* — Tho D Ta
(74) *Attorney, Agent, or Firm* — Andrew C. Cheng; Wei Te Chung; Ming Chieh Chang

(57) ABSTRACT

A contact sheet (100) comprises a first contact strip (1), a second contact strip (4) coplanar with the first contact strip (1) and a plurality of first contacts (2) and second contacts (3) located between the first contact strip (1) and the second contact strip (4) alternatively, the first contact (2) comprises a first body portion (21) having a first notch (211) and a first protruding portion (212), the second contact (3) comprises a second body portion (31) having a second notch (311) and a second protruding portion (312), the first protruding portion (212) fits with the second notch (311), the second protruding portion (312) fits with the first notch (211).

20 Claims, 6 Drawing Sheets

CONTACT CARRIER HAVING CONTACT TERMINALS ARRANGED ALTERNATIVELY ALONG SIDES

BACKGROUND OF THE INVENTION

1. Field of the Invention

The present invention relates to a contact carrier, and more particularly, to a contact carrier having a plurality of contact terminals arranged alternatively along sides of the carrier and interposing with respect each other so as to efficiently make use of the carrier.

2. Description of the Related Art

U.S. Pat. No. 6,976,888 issued to Tokorozawa on Dec. 20, 2005 discloses a conventional electrical contact. The electrical contact is stamped from a metal plate and remains attached to a carrier strip after stamping. The electrical contact comprises a base plate, an elastic plate portion extending from the upper of the base plate, a spring arm bending from the upper of the elastic plate portion and a solder ball attachment paddle extending from the bottom end of the base plate. The upper ends of the elastic plate portion are connected to the carrier strip. When the electrical contacts are assembled to an insulative housing, the carrier strip carries a number of electrical contacts for simultaneously fitting the electrical contacts into the passageways of the insulative housing.

Due to there is a distance between adjacent passageways of the insulative housing, there must be a distance between the two adjacent electrical contacts connected to the carrier strip, otherwise the electrical contacts on the carrier strip will not match with the passageways one to one. When the electrical contacts are stamped and formed, the materials between the two adjacent electrical contacts are cut away. This produces many waste materials and adds the cost.

U.S. Pat. No. 6,922,889 issued to Tsai on Aug. 2, 2005 discloses a shifting device for shifting two rows of continuous terminals includes a body and a shaft. The body is formed with a hole and an inlet and an outlet both communicating with the hole. A direction into the inlet and a direction out of the outlet are the same. The inlet is shifted a predetermined distance away from the outlet. The shaft is fitted with the hole of the body and defines a spiral channel with the body after fitting with the hole of the body. The spiral channel corresponds to the inlet and the outlet of the body. According to the structure, one row of the continuous terminals enters the body from the inlet and travels along the spiral channel and travels out of the body from the outlet with a predetermined distance shifted away from the other row of the continuous terminals. As it can be readily seen from FIGS. 1 and 2, a contact carrier is arranged with two rows of contact terminals either facing back to back or facing each other. According to the disclosure, the carrier can make most of the contact terminals.

Hence, an improved contact sheet and the electrical contacts arranged thereon is required to overcome the disadvantages of the prior art.

SUMMARY OF THE INVENTION

An object of the invention is to provide a contact sheet and electrical contacts arranged thereon to save materials.

To achieve the above-mentioned object, a contact sheet comprises a first contact strip, a second contact strip coplanar with the first contact strip and a plurality of first contacts and second contacts located between the first contact strip and the second contact strip alternatively, the first contact comprises a first body portion having a first notch and a first protruding portion, the second contact comprises a second body portion having a second notch and a second protruding portion, the first protruding portion fits with the second notch, the second protruding portion fits with the first notch.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
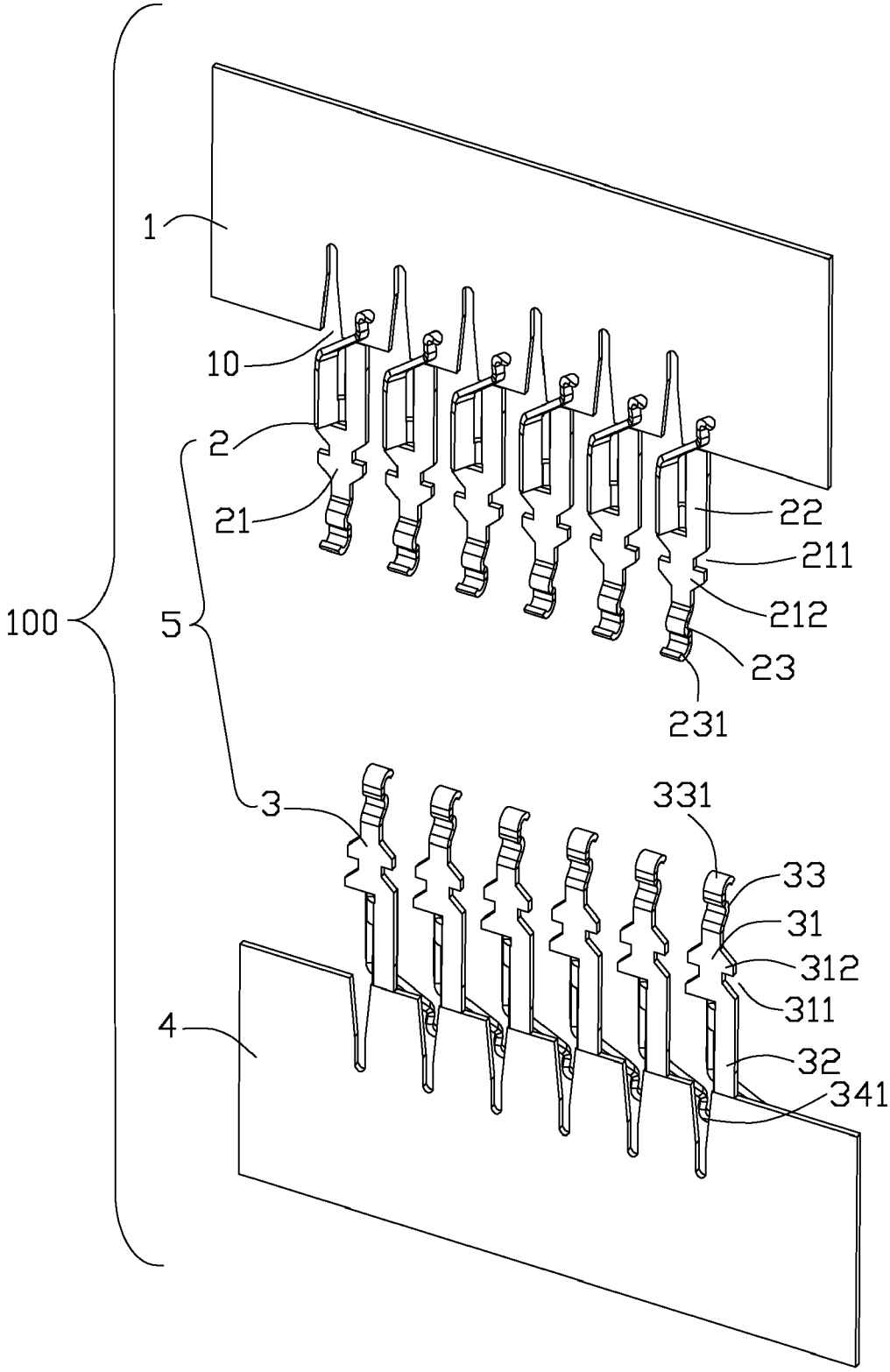
FIG. 1 is an exploded, perspective view of a contact sheet in accordance with a preferred embodiment of the present invention.
Figure 2:
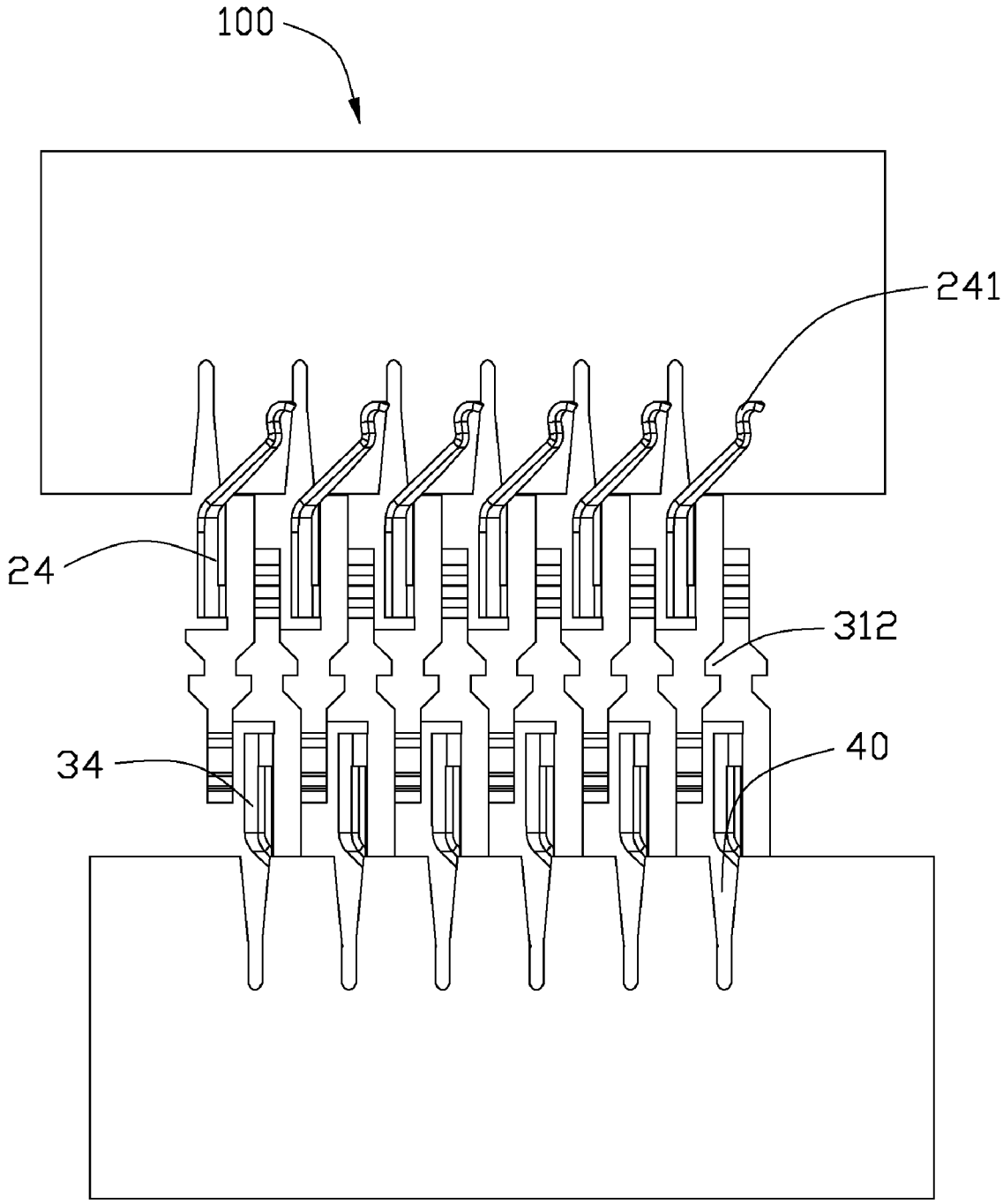
FIG. 2 is an assembled view of the contact sheet shown in FIG. 1.
Figure 3:
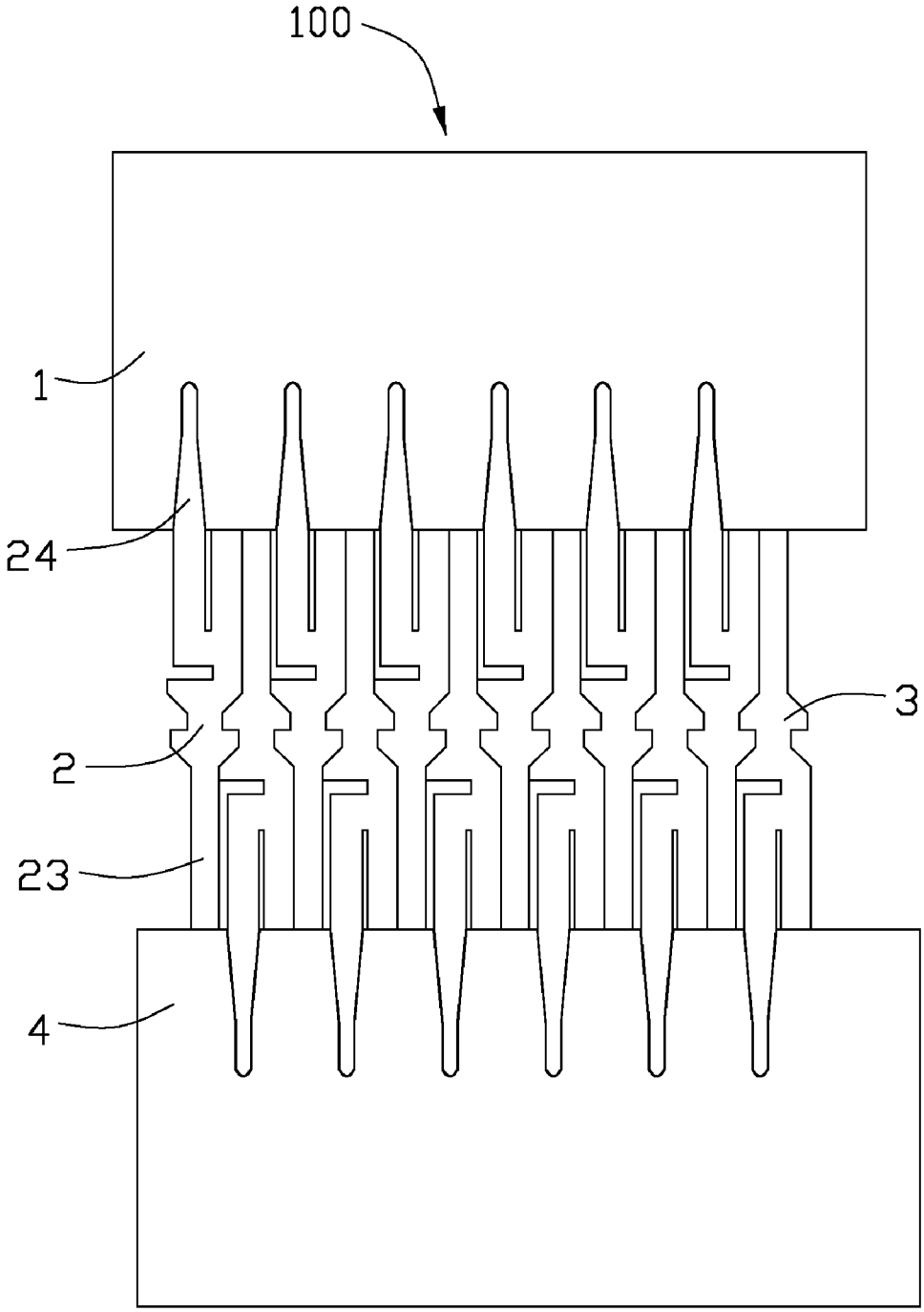
FIG. 3 is similar to FIG. 2, showing the electrical contacts are spread.

Referring to FIGS. 1-3, the contact sheet 100 is stamped from a metal plate and comprises a first contact strip 1, a second contact strip 4 coplanar with the first contact strip 1 and a plurality of contacts 5 located between the first contact strip 1 and the second contact strip 4. The contacts 5 each comprises a first contact 2 connected to the first contact strip 1 and a second contact 3 connected to the second contact strip 4. The first contact 2 and the second contact 3 are used to electrically connecting an IC (Integrated Circuit) package (not shown) to a printed circuit board (not shown) respectively. The first contact strip 1 comprises a first gap 10. The second contact strip 4 comprises a second gap 40.

The first contact 2 comprises a flat first body portion 21, a first connecting portion 22 extending upwardly from the first body portion 21, a first spring arm 24 extending curvedly and upwardly from the first connecting portion 22 and a first rear portion 23 extending downwardly from the first body portion 21. The first body portion 21 comprises a first notch 211 and a first protruding portion 212. The first connecting portion 22 is connected to the first strip 1. The first spring arm 24 comprises a first contact portion 241 at top end thereof to connect with the IC package, and the first rear portion 23 comprises a first arc engage portion 231 to connect with the printed circuit board.

In this embodiment, the second contact 3 is identical with the first contact 2. Also, the second contact 3 may be not identical with the first contact 2. The second contact 3 comprises a flat second body portion 31, a second connecting portion 32 extending upwardly from the second body portion 31, a second spring arm 34 extending curvedly and upwardly from the second connecting portion 32 and a second rear portion 33 extending downwardly from the second body portion 31. The second body portion 31 comprises a second notch 311 and a second protruding portion 312. The second connecting portion 32 is connected to the second strip 4. The second spring arm 34 comprises a second contact portion 341 at free end thereof to connect with the IC package, and the second rear portion 33 comprises a second arc engage portion 331 to connect with the printed circuit board point to point.

Referring FIG. 3, before the contacts 5 are cut out from the contact sheet 100 and are bent, the first contacts 2 and the second contacts 3 are located between the first contact strip 1 and the second contact strip 4 alternatively. The first spring arm 24 fits with the first gap 10 of the first contact strip 1 and the first rear portion 23 connects with the second contact strip 4. The second spring arm 34 fits with the second gap 40 of the first contact strip 4 and the second rear portion 33 connects with the first contact strip 1.

The first protruding portion 212 of the first body portion 21 fits with the second notch 311, the second protruding portion 312 of the second body portion 31 fits with the first notch 211 of the first body portion 21. The end of the second rear portion 33 is connected with the first contact strip 1 and there is no gap between the second rear portion 33 and the first connecting portion 22. The end of the first rear portion 23 is connected with the second contact strip 4 and there is no gap between the first rear portion 23 and the second connecting portion 32. Thus, there is no waste material between the first protruding portion 212 and the second notch 311, the second protruding portion 312 and the first notch 211, and the second rear portion 33 and the first connecting portion 22 of each contact 5 respectively. The waste material is only generated between the first rear portion 23 and the second spring arm 34, the second spring arm 34 and the second connecting portion 32, and the first spring arm 24 and the first connecting portion 22 of each contact 5 respectively.

In this embodiment, the size of the first protruding portion 212 is equal to that of the second notch 311 and the size of the second protruding portion 312 is equal to that of the first notch 211. Also, the size of the first protruding portion 212 may not be equal to that of the second notch 311 and the size of the second protruding portion 312 may not be equal to that of the first notch 211.

Figure 4:
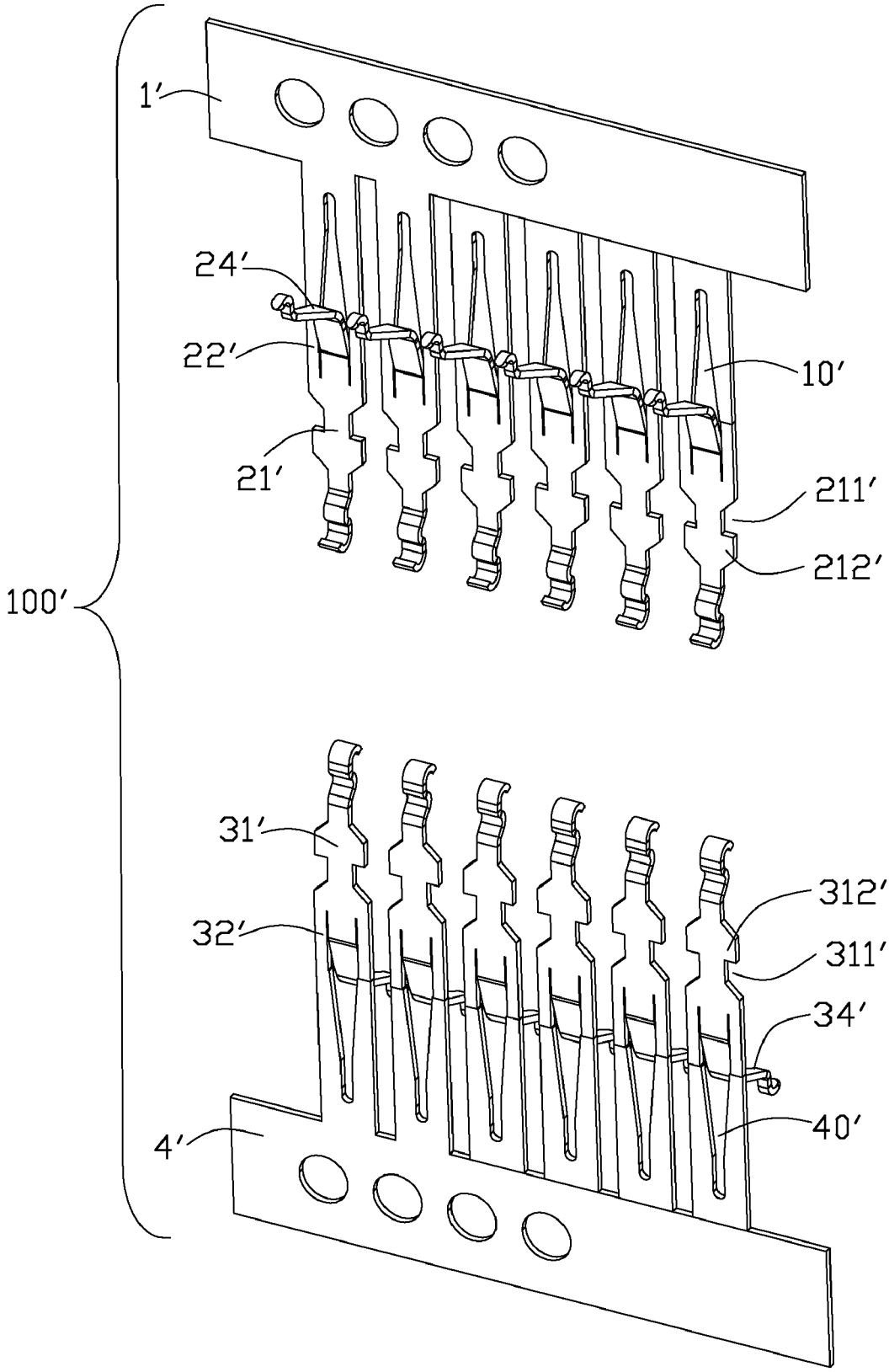
FIG. 4 is an exploded view of a second embodiment of the contact sheet.
Figure 5:
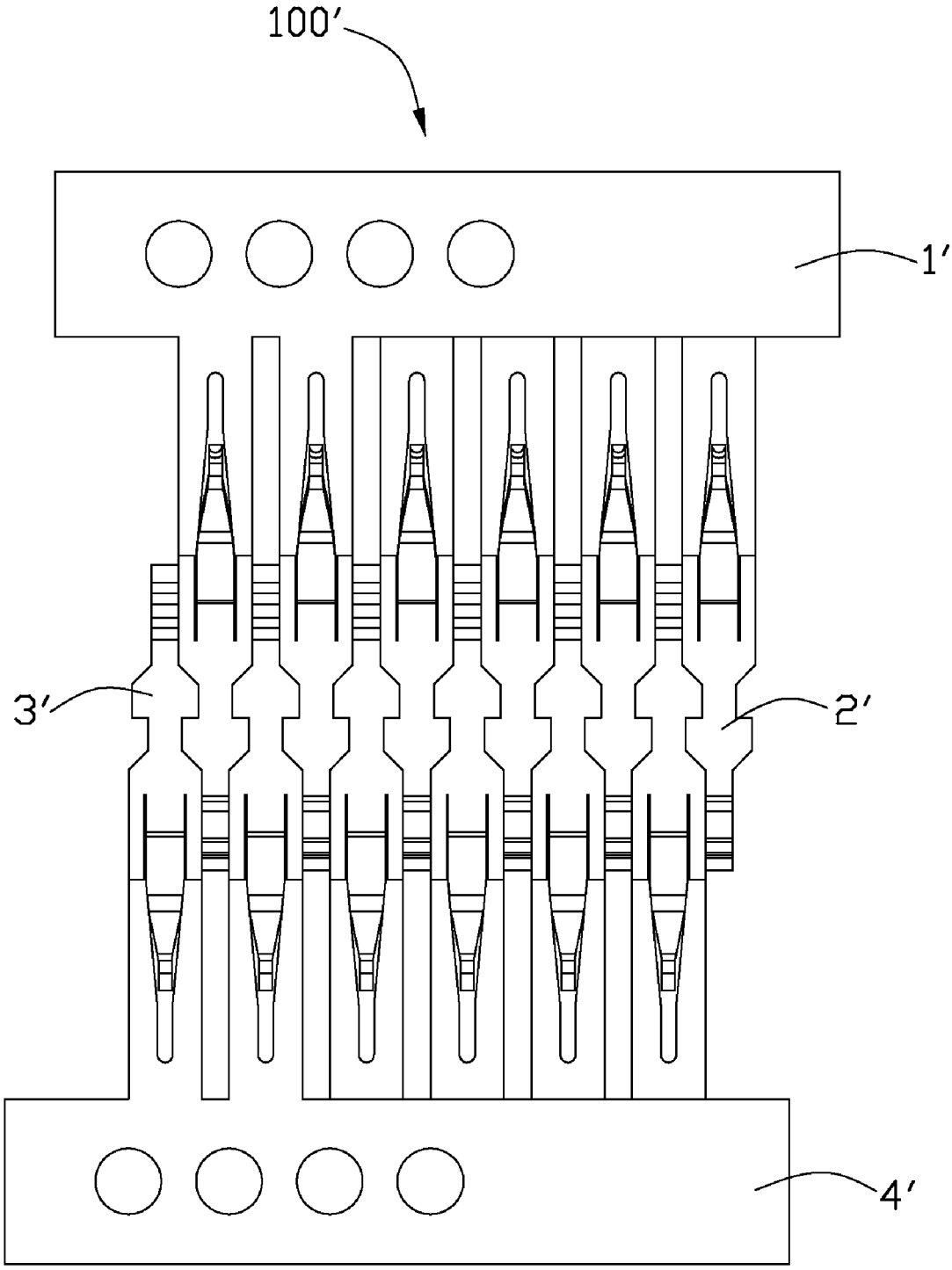
FIG. 5 is an assembled view of the contact sheet shown in FIG. 4.
Figure 6:
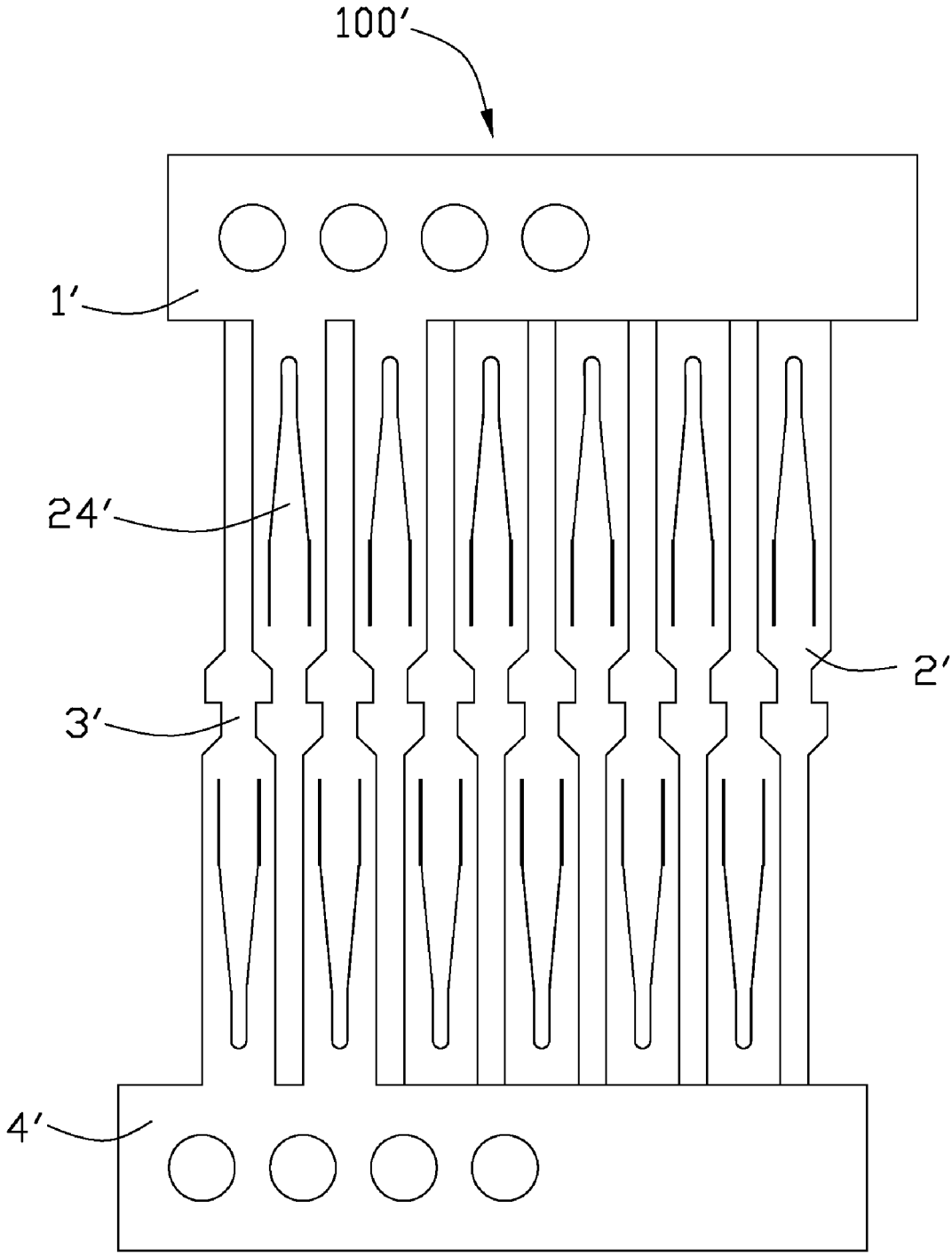
FIG. 6 is similar to FIG. 5, showing the electrical contacts are spread.

Referring to FIGS. 4-6, shown a second embodiment of the contact sheet 100'. The differences are as following: the first contact 2' and the second contact 3' are bilateral symmetry along the central axis. The first contact 2' comprises a pair of first connecting portions 22' extending upwardly from the first body portion 21' and connect with the first contact strip 1', the first spring arm 24' is located between the pair of first connecting portions 22'; the second contact 3' comprises a pair of second connecting portions 32' extending upwardly from the second body portion 31' and connects with the second contact strip 4', the second spring arm 34' is located between the pair of second connecting portions 32'. The first protruding portion 212' of the first body portion 21' fits with the second notch 311', the second protruding portion 312' of the second body portion 31' fits with the first notch 211' of the first body portion 21'. There is no waste material between top end of the first connecting portion 22' and bottom end of the second connecting portion 32'.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A contact sheet, comprising:

a first contact strip;

a second contact strip coplanar with the first contact strip; and a plurality of first contacts and second contacts located between the first contact strip and the second contact strip alternatively, the first contact comprising a first body portion having a first notch and a first protruding portion, the second contact comprising a second body portion having a second notch and a second protruding portion, the first protruding portion fitting with the second notch, the second protruding portion fitting with the first notch.

2. The contact sheet as described in claim 1, wherein the first contact comprises a first connecting portion extending upwardly from the first body portion and a first rear portion extending downwardly from the first body portion and connecting with the first contact strip, and the second contact comprises a second connecting portion extending upwardly from the second body portion and a second rear portion extending downwardly from the second body portion and connecting with the second contact strip.

3. The contact sheet as described in claim 2, wherein the second rear portion and the first connecting portion connecting to each other.

4. The contact sheet as described in claim 2, wherein the first contact comprises a first spring arm extending laterally and upwardly from the first connecting portion, and the second contact comprises a second spring arm extending laterally and upwardly from the second connecting portion.

5. The contact sheet as described in claim 4, wherein there is a gap between the second spring arm and the second connecting portion, and there is a gap between the first rear portion and the second spring arm.

6. The contact sheet as described in claim 4, wherein the first contact strip comprises a first gap fits with the first spring arm, the second contact strip comprises a second gap fits with the second spring arm.

7. The contact sheet as described in claim 1, wherein the second contact is identical with the first contact.

8. The contact sheet as described in claim 1, wherein the first contact comprises a first spring arm extending upwardly from the first body portion and a pair of first connecting portions at opposite sides thereof and connected with the first contact strip, wherein the second contact comprises a second spring arm extending upwardly from the second body portion and a pair of second connecting portions at opposite sides thereof and connected with the first contact strip.

9. The contact sheet as described in claim 8, wherein the first contact and the second contact connected with each other between top end of the first connecting portion and bottom end of the second connecting portion.

10. An electrical contact, comprising:

a first contact comprising a first body portion having a first notch and a first protruding portion;

a second contact comprising a second body portion having a second notch and a second protruding portion; wherein the first notch, the first protruding portion, the second notch and the second protruding portion are configured and dimensioned to allow the first contact and the second contact to be originally formed on a same contact sheet with opposite orientations under condition that the first protruding portion connects with the second notch, and the second protruding portion connects with the first notch on the contact sheet.

11. The electrical contact as described in claim 10, wherein the first contact comprises a first connecting portion extending upwardly from the first body portion and a first rear portion extending downwardly from the first body portion and connecting with the first contact strip, and the second contact comprises a second connecting portion extending upwardly from the second body portion and a second rear portion extending downwardly from the second body portion and connecting with the second contact strip, the second rear portion and the first connecting portion connecting with each other on the contact sheet.

12. The electrical contact as described in claim 11, wherein the first contact comprises a first spring arm extending laterally and upwardly from the first connecting portion, the second contact comprises a second spring arm extending laterally and upwardly from the second connecting portion.

13. The electrical contact as described in claim 12, wherein there is a gap between the second spring arm and the second connecting portion, and there is a gap between the first rear portion and the second spring arm.

14. The electrical contact as described in claim 10, wherein the second contact is identical with the first contact.

15. The electrical contact as described in claim 10, wherein the first contact comprises a first spring arm extending upwardly from the first body portion and a pair of first connecting portions at opposite sides thereof and connecting with the first contact strip, the second contact comprises a second spring arm extending upwardly from the second body portion and a pair of second connecting portions at opposite sides thereof and connecting with the first contact strip.

16. The electrical contact as described in claim 15, wherein the first contact and the second contact connect with each other between top end of the first connecting portion and bottom end of the second connecting portion.

17. A method of making contacts derived from a same metal sheet, comprising steps of:

providing a metal sheet with opposite first and second contact strips on two opposite side areas;

providing a plurality of identical contacts which are arranged with first and second sets of contacts unitarily extending from the first contact strip and the second contact strip toward each other in an opposite orientations in a lateral direction and in an alternate manner in a longitudinal direction perpendicular to said lateral direction; wherein the first sets of contacts are same with the second sets of contacts, and each of said contacts including a mating section for mating with an electronic package, a mounting section for mounting to a printed circuit board and a retaining section therebetween for retaining the contact in a corresponding housing; wherein a notch and a protruding portion are successively formed on each side edge of the contact around the corresponding retaining section under condition that the protruding portion are configured and dimensioned to be compliant with the notch so that for each contact, the notch and the protruding portion on each side edge are respectively unitarily coupled to the protruding portion and the notch of the neighboring contact located by said side edge and having the opposite orientation under a dense arrangement.

18. The method as described in claim 17, wherein the mating sections of the first set of contacts and the second set of contacts are bent curvedly to form final shape before the first and second contact strip are removed, under condition that the curved mating sections of the first set of contacts extend away from the metal sheet in a first vertical direction perpendicular to said lateral direction and said longitudinal direction while the curved mating sections of the second set of contacts extend away from the metal sheet in a second vertical direction opposite to said first direction.

19. The method as described in claim 18, wherein the mating section is located at a center line of the corresponding contact.

20. The method as described in claim 17, wherein a center line of the metal shell in the longitudinal direction is also a boundary between the notch and the protruding portion of each contact.

* * * * *